US005286435A

United States Patent [19]

Slutsker et al.

[11] Patent Number: 5,286,435

[45] Date of Patent: Feb. 15, 1994

[54] PROCESS FOR FORMING HIGH STRENGTH, HIGH MODULUS POLYMER FIBERS

[75] Inventors: Leonid I. Slutsker, Akron; Kenneth R. Lucas, Copley; Georg G. A. Bohm, Akron, all of Ohio

[73] Assignee: Bridgestone/Firestone, Inc., Akron, Ohio

[21] Appl. No.: 143,246

[22] Filed: Dec. 31, 1987

Related U.S. Application Data

[63] Continuation of Ser. No. 826,714, Feb. 6, 1986, abandoned.

[51] Int. Cl.[5] ..... D01F 6/00

[52] U.S. Cl. ..... 264/205; 264/178 F; 264/203; 264/210.8

[58] Field of Search ..... 264/205, 210.8, 203, 264/178 F

[56] References Cited

U.S. PATENT DOCUMENTS

| | | | |
|---|---|---|---|
| 4,056,516 | 11/1977 | Albers et al. | 526/287 |
| 4,344,908 | 8/1982 | Smith et al. | 264/203 |
| 4,356,138 | 10/1982 | Kavesh et al. | 264/164 |
| 4,413,110 | 11/1983 | Kavesh et al. | 526/348.1 |
| 4,430,383 | 2/1984 | Smith et al. | 428/364 |
| 4,436,689 | 3/1984 | Smith et al. | 264/204 |
| 4,440,711 | 4/1984 | Kwon et al. | 264/185 |
| 4,663,101 | 5/1987 | Kavesh et al. | 264/178 F |
| 5,068,073 | 11/1991 | Pennings et al. | 264/205 |
| 5,106,563 | 4/1992 | Yagi et al. | 264/205 |

FOREIGN PATENT DOCUMENTS

| | | |
|---|---|---|
| 0055001 | 6/1982 | European Pat. Off. . |
| 0077590 | 4/1983 | European Pat. Off. . |

OTHER PUBLICATIONS

P. Smith, P. J. Lemstra, B. Kalb and A. J. Pennings, Polymer Bulletin, 1, 733 (1979).

P. Smith and P. J. Lemstra, J. Mater. Sci., 15, 505 (1980).

P. Smith and P. J. Lemstra, Makromol. Chem., 180, 2983 (1979).

P. Smith and P. J. Lemstra, Colloid and Polym. Sci., 258, 891 (1980).

P. Smith and P. J. Lemstra, Polymer, 21, 1341 (1980).

P. Smith, P. J. Lemstra and H. C. Booij, J. Polym. Sci, A-2, 19 877 (1981).

P. J. Lemstra and P. Smith, British Polym. J., 12, 212 (1980).

P. Smith and P. J. Lemstra, J. Polym. Sci., A-2, 19, 1007 (1981).

J. Smook, M. Flinterman and A. J. Pennings, Polymer Bulletin, 2, 775 (1980).

J. Smook, J. C. Torfs, P. F. Van Hutten and A. J. Pennings, Polymer Bulletin, 2, 293 (1980).

J. Smook, J. C. Torfs and A. J. Pennings, Makromol. Chem., 182, 3351 (1981).

B. Kalb and A. J. Pennings, Polymer, 21, 3 (1980).

B. Kalb and A. J. Pennings, J. Mater. Sci., 15, 2584 (1980).

B. Kalb and A. J. Pennings, Polymer Bulletin, 1, 871 (1979).

J. Smook and A. J. Pennings, J. Appl. Polym. Sci., 27, 2209 (1982).

*Primary Examiner*—Edward A. Miller

*Attorney, Agent, or Firm*—Frank J. Troy, Sr.

[57] ABSTRACT

Fibers of linear polyethylene or polypropylene are solution spun, cooled, dried in hot air and hot drawn. Drying and hot drawing are carried out by passing a moving filament of the wet polymer through a hot air dryer having an air temperature of at least 55° C., preferably at least 60° C., then heating and hot drawing a moving filament of the dried fiber. Optional steps include wet drawing the fiber prior to drying, and solvent exchange of the original solvent, e.g. decalin, for a more volatile solvent.

7 Claims, 2 Drawing Sheets

10
12
14
16
18

20
22
14
18

26
24
14
22

10
12
14
16
18

20
22
14
28
18

26
24
22

PROCESS FOR FORMING HIGH STRENGTH, HIGH MODULUS POLYMER FIBERS

This application is a continuation of application Ser. No. 06/826,714, filed Feb. 6, 1986, now abandoned.

TECHNICAL FIELD

This invention relates to processes for producing high tensile strength, high modulus filaments from flexible chain polymers.

BACKGROUND ART

It is well known in the fiber industry that high modulus, high tenacity fibers can be prepared from rigid, wholly aromatic chain polymers such as aramid ("Kevlar", which is a registered trademark of E. I. duPont de Nemours & Co.). Although "Kevlar" has become widely used, its high cost limits its use primarily to specialty products.

Patents and scientific literature suggest that high strength fibers can be produced from flexible chain polymers, in particular polyethylene. As far as the current applicants are aware, however, no processes for producing flexible chain polymer fibers have been commercialized.

Processes for making fibers of polyethylene and other flexible chain polymers by solution spinning are well known. One example of such process is that described in U.S. Pat. No. 4,344,908 to Smith et al. According to Smith et al, a polyethylene gel fiber is formed by solution spinning, immediately cooled in a water bath at room temperature, and thereafter simultaneously heated, dried and stretched. A number of other references also describe solution spinning processes for producing polyethylene fibers in which heating, drying and stretching, or drawing as it is also known, are carried out simultaneously. For example, an article by Smith et al in *Polymer*, 1980, Vol. 21, November, pgs. 1341–1343, shows that solution spun polyethylene gel fibers which are simultaneously drawn and dried at elevated temperature immediately after they are generated have higher tensile strength at the same draw ratio than do filaments which are dried at room temperature and then subsequently drawn.

U.S. Pat. No. 4,413,110 describes processes for making high tenacity, high modulus polyethylene and polypropylene fibers by solution spinning, followed by cooling, solvent exchange and drying the fiber. The inventors report that they have a dense, void-free structure from the time of spinning until the dried, low-void fiber is obtained. This is achieved by slow cooling between the spinerette and the bath, which is achieved with a long air gap (at least 7.5 cm). In different modes of operation, the fiber is stretched either before solvent exchange, or after drying, or in two stages, one before solvent exchange and the other after drying. In each case the fiber is drawn in a heated tube. The methods of drying as reported in the examples are air drying at room temperature and vacuum evaporation at 22°–50° C. (No details as to drying are given except in the examples). Hot stretch (hot draw) feed roll speeds tend to be quite low, for example 2 or 4 cm/min.

European Patent Application, Publication No. 0055001 discloses a process for making filled polyethylene filaments by solution spinning followed by stretching. Stretching temperatures are from 75° to 135° C. The filament can be stretched without substantial solvent evaporation, or a portion of the solvent may be removed (preferably to less than 10 percent by weight of solvent) by various means such as washing, evaporation or hot air drying, followed by stretching. Filament speeds are not disclosed.

None of the drying conditions employed in the references cited above lend themselves to high speed continuous processing.

DISCLOSURE OF THE INVENTION

It is an object of this invention to produce a flexible chain polymer fiber having high modulus and high strength.

It is a related object of this invention to provide a process for producing linear polyethylene fibers of high modulus and high strength.

It is a related object of this invention to provide a process for producing high strength, high modulus flexible chain polymers in which filament speeds are higher than those used heretofore.

These and other objects of this invention are realized in a process for making a polymer filament having a high tensile strength and high modulus comprising the steps of:

(a) spinning a solution of polyethylene or polypropylene having a weight average molecular weight of at least about 500,000 and containing from about 0.5 to 20 weight percent polymer through an aperture at a temperature above the gelation temperature of the solution and below the boiling point of the solvent, thereby forming a wet spun filament;

(b) cooling said wet spun filament to a temperature below the gelation temperature of said solution, thereby forming a gel fiber filament;

(c) continuously passing the gel filament through a drying zone which is maintained at a temperature from about 55° C. to the melting point of the polymer, and at a pressure of not less than substantially atmospheric pressure; and (d) continuously passing the dried filament through a hot drawing zone in which said filament is heated and hot drawn.

BEST MODE FOR CARRYING OUT THE INVENTION

The starting polymer for the practice of the present invention is a high molecular weight, essentially linear flexible chain polymer which is capable of orientation on stretching or drawing and which can be spun from dilute solution. Suitable polymers are either amorphous or semi-crystalline in the unoriented state. The starting polymer has a weight average molecular weight ($M_W$) of at least 500,000 and preferably at least 1,000,000. Suitable polymers include polyethylene and polypropylene. A preferred starting polymer is linear polyethylene having a weight average molecular weight of at least 500,000 and preferably at least 1,000,000. Isotactic polypropylene is also suitable.

The starting polymer is dissolved in a suitable solvent to prepare a solution which can be extruded through a die to form a filament. The solvent must be one in which the polymer can be dissolved in a concentration high enough to give a solution suitable for spinning. Also, the solvent must be a liquid at the desired spinning temperature, and should therefore have a boiling point in excess of the melting point of the polymer. Decalin (i.e., decahydronaphthlene) is the preferred solvent. Low molecular weight aliphatic hydrocarbons such as paraffin oil can also be used.

The concentration of the polymer in solution is such as to give a solution suitable for spinning. Also, the solvent and polymer concentration are such that a gel will result when the filament formed by spinning is cooled. Ordinarily the polymer concentration is from 0.5 percent to about 20 percent of total solution weight, preferably from about 1 to about 10 percent of total solution weight.

The suitable starting polymers, solvents, and concentrations of polymer in solution are the same in all embodiments of the current invention. Different processing techniques will give the desired high modulus, high strength fibers. Three such techniques will be described in further detail for purposes of illustration.

The first embodiment of this invention will now be described with reference to FIGS. 1A, 1B, and 1C. According to this embodiment of the invention, a polymer filament is formed by solution spinning, cooled, dried and hot drawn. There is no significant wet drawing (i.e., drawing either in or before the drier) according to this embodiment of the invention. Also according to this embodiment, the spinning solution solvent remains in the filament or fiber until removed by drying.

Figures 1A, 1B, 1C:
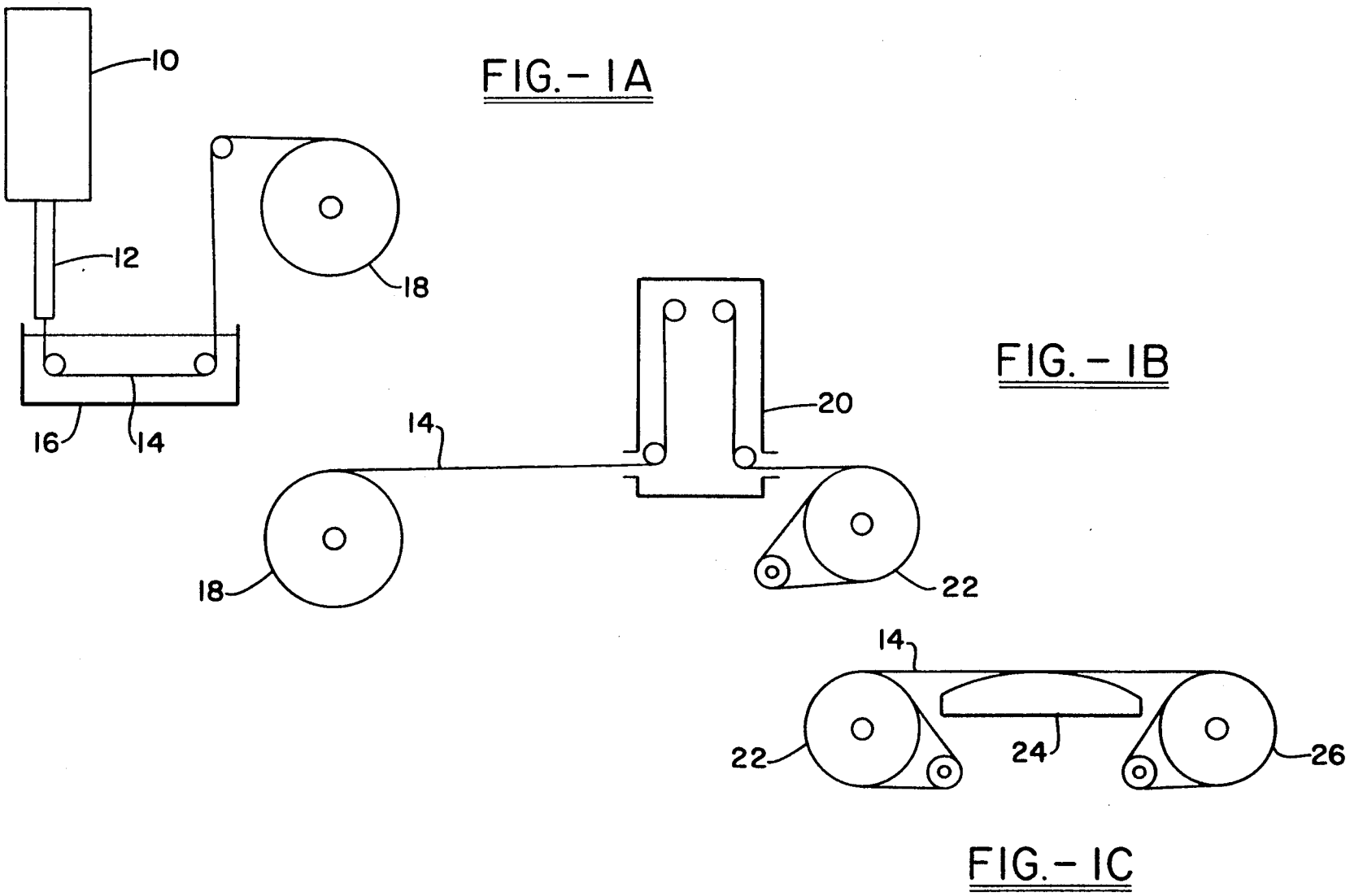
FIGS. 1A, 1B, and 1C are schematic illustrations of successive steps of a process according to a first embodiment of the invention, in which a flexible chain polymer is spun, dried and hot drawn.

Referring now to FIG. 1A, a solution of a polymer (e.g. polyethylene) in a suitable solvent (e.g. decalin) is formed in solution tank 10. The temperature in this solution tank is above the gelation temperature of the solution but below the boiling point of the solvent and is typically from about 120 to about 150° C. The solution is extruded through a spinneret 12 having a small aperture die (typically 1 mm in diameter) at its forward end. Extrusion through spinneret 12 is carried out under pressure, typically about 12 to 22.5 psig. Nitrogen or other inert gas in vessel 10 supplies the required pressure. This results in the formation of a wet spun filament, which quickly cools to below the gelation temperature of the solution forming a gel fiber filament 14. The filament 14 ordinarily traverses a small air gap (typically from 2 mm to about 30 mm in length), and is then quenched to form a gel by cooling in water bath 16, which is filled with water at room temperature or lower. However, the solution can be extruded beneath the surface of the water bath if desired. Water flows into this water bath in a direction opposite to the direction of fiber movement. (The water entrance and exit are omitted from the schematic diagram). Rapid cooling of the polymer solution strand and the resultant gel fiber from the temperature in solution tank 12 to a temperature below the gelation temperature is highly desirable. This should result in a fiber having a substantial void volume, in contrast to the low porosity xerogel fibers obtained in the process of U.S. Pat. No. 4,413,110. The cooling time in air between the spinerette 12 and the water bath 16 is preferably no more than about 5 seconds, which corresponds to a minimum cooling rate of at least about 20° C./sec. Quenched gel fiber 14 is wound on take-up drum 18. The take-up speed may vary over a wide range, e.g. from about 410 to 2,050 cm per minute. Higher or lower take-up speeds may be used.

The cooled polymer gel fiber is dried in the next step, which is shown in FIG. 1B. To this end, polymer gel fiber 14 is unwound from drum 18, continuously passed through hot air dryer 20 and is taken up on taken-up drum 22. Both feed drum 18 and take-up drum 22 are separately motor driven. Dryer 20 preferably has a plurality of rolls over which the fiber passes, with simultaneous drying and removal of voids. A hot air current passing through drier 20 maintains the drier temperature at a desired level, from about 55° C., preferably at least 60° C., up to but not including the melting point of the polymer being dried. The drying temperature does not exceed the melting point of the fiber. The drying temperature for this embodiment of the invention is preferably from about 60° C. to about 100° C., most preferably from about 80° C. to about 100° C. The drying temperature should always be at least about 60° C. when the original solvent (e.g. decalin) remains in the gel fiber until drying, i.e., when there is no solvent exchange. Drying is carried out at substantially atmospheric pressure or higher; use of vacuum is neither necessary or desirable. Drying with a hot gas is preferred, although other modes of drying, e.g. heated rolls, may be used. Air is the preferred drying gas because of its low cost; however, other hot gases, e.g. nitrogen or nitrogen/carbon dioxide mixtures may be used. A non-oxidizing atmosphere may be utilized but is not normally required because the polymer fiber usually contains an antioxidant. Use of a drying temperature of at least 60° C., preferably higher, is important in order to obtain the desired physical characteristics of tensile strength in excess of 20 grams per denier and modulus in excess of 700 grams per denier in the product fiber at the high operating speeds which make the present process attractive.

A slight degree of stretching or drawing takes place during the drying step; this is accomplished by running take-up drum 22 at a slightly faster speed than feed drum 18. Typical draw ratios in the drying step (i.e. drier draw ratios) are about 1.2/1 to about 1.3/1. A typical feed roll speed is about 300 cm per minute and a typical take-up roll speed is about 360 cm per minute. Faster speeds may be used without risk of breakage; however, faster filament speed requires a larger capacity drier in order to obtain the desired drier residence time. Drying (removal of solvent), annealing and densification of the fiber structure takes place during the drying step. The filament can then be hot drawn at a high draw ratio without breakage in the subsequent hot drawing step to obtain a filament having high strength and modulus.

The residence time of the wet fiber in drier 20 is such as to bring the solvent content of the fiber or filament down to no more than about 5 percent of total filament weight. Lower solvent contents are acceptable and even preferred. For instance, according to this first embodiment of the invention in which there is no drawing before drier 20, a filament dried at 72° C. for 4.5 minutes has been found to have an exit solvent content of 2.9 percent by weight, while drying at 80° C. for 4.5 minutes results in an exit solvent content of 0.7 percent by weight. Higher drying temperatures of course result in an even lower solvent content in the dried filament. As the data show, solvent content drops sharply as the drying temperature is increased. Filaments dried at 100° C. have a near zero solvent content.

The dried filament, having a solvent content generally not in excess of 5 percent by weight and in some cases as low as 0.5 percent by weight, is hot drawn to impart the desired physical characteristics of high tensile strength and high modulus. This step is shown in FIG. 1C. The filament is unwound from drum 22, heated to the desired hot drawing temperature by suitable means such as hot plate 24, and taken upon power driven wind-up drum 26. The linear speed of drum 26 is faster than that of drum 22. The ratio of linear speeds of the wind-up surface of drum 26 and the surface from which the filament 14 is unwound on drum 22 is the hot stretch or draw ratio.

The moving filament 14 may be heated by any desired means which will give the required temperature and time for hot drawing. A hot plate (which may be electrically heated) is shown; however, other heating means, such as a tunnel or hot tube heated by hot air, steam or other convenient means can be used instead. Hot drawing temperatures of about 145° C. (or more broadly, about 140°-150° C.) in the case of polyethylene fibers, with heating times anywhere from about 2½ to about 20 seconds have been found to give good results. Lower hot drawing temperatures, e.g. as low as 125° C. can be used, but ordinarily hot drawing temperatures of at least 140° C. are preferred.

The draw ratio in the hot drawing stage according to this first embodiment of the invention can be anywhere from about 20/1 to about 45/1. As is well known in the art, best physical properties such as tensile strength and tensile modulus are obtained by using the highest possible draw ratio, so that the draw ratio is preferably as high as possible without danger of breakage. Best physical properties in this first embodiment of the invention are obtained when the hot drawing draw ratio is in the range of about 30/1 to about 45/1. The maximum draw ratio which can be attained depends on the temperature and time of heating; higher temperatures and/or longer heating times are associated with higher attainable draw ratios.

The total or overall draw ratio in the first embodiment may range from about 24/1 up to about 60/1 or higher. Typical draw ratios range from about 36/1 to about 54/1. Best results are obtained when the total draw ratio is at least 36/1. The total draw ratio is the product of the draw ratios in each step in which drawing takes place.

Tensile modulus values ranging from about 800 grams per denier (g/d) up to more than 900 g/d are obtainable according to the first embodiment of this invention. Tenacities obtainable according to the first embodiment of this invention generally range from about 31 to about 36 g/d. Tenacity is a measure of tensile strength; in fact, the two terms are interchangeable.

Figures 2A, 2B, 2C:
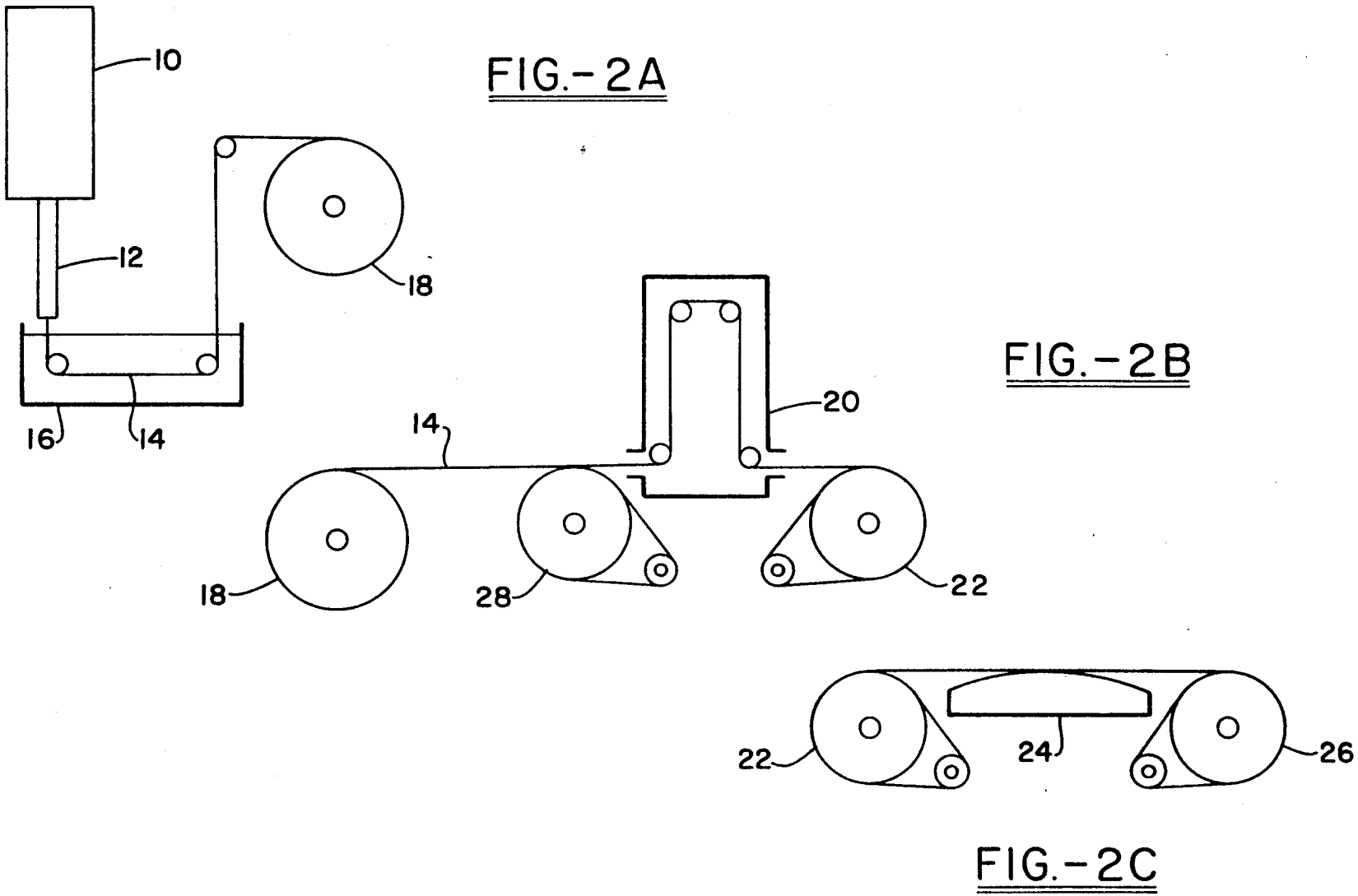
FIGS. 2A, 2B, and 2C are schematic illustrations of successive steps of a process according to a second embodiment of the invention, in which a flexible chain polymer is spun, wet drawn, dried and hot drawn.

The second embodiment of this invention will now be described in detail with reference to FIGS. 2A, 2B, and 2C. According to the second embodiment of this invention, the wet spun filament after cooling is wet drawn in air under ambient conditions, dried and then hot drawn. The spinning solution solvent remains in the filament until removed by drying, as in the first embodiment. The apparatus required for the second embodiment is like that required for the first embodiment, except that a driven roller 28, shown in FIG. 2B, is interposed between drum 18 (which is the feed drum for the wet drawing and drying operation) and the drier 20. The wet draw ratio of the second embodiment, which is the ratio of the linear speed at the surface of roller 28 to linear speed at the surface of drum 18, is typically in the range of about 2/1 to about 7/1. Filament 14 is unwound from feed drum 18, is wound up continuously on roller 28, simultaneously is unwound from roller 28 continuing through drier 20 to take-up roll 22. Wet drawing is typically carried out at ambient temperature (about 20° C.) in air. The drying temperatures in drier 20 of this second embodiment may be from about 60° C. to about 100° C., i.e., the same as in the first embodiment. As in the first embodiment, some drawing takes place in drier 20; a typical drier draw ratio is about 1.2/1. The hot draw ratio in the second embodiment is typically from about 6/1 to about 32/1, which is somewhat lower than in the first embodiment of the invention, although the ranges overlap.

The solvent content of dried fibers prepared according to the second embodiment ranges from near zero to a maximum of about 8 percent, depending on drying temperature, drying time, and wet draw ratio. For example, at a drying temperature of 60° C. and a drying time of about 4.5 minutes, the decalin content of the product fiber varies with wet draw ratio as follows:

| Wet Draw Ratio | Decalin Content |
|---|---|
| 2:1 | 7% |
| 4:1 | 5% |
| 7.8:1 | 1.4% |

Higher drying temperatures result in much lower decalin content in the product fiber; the moisture content is near zero in products fiber; the moisture content is near zero in products dried at 100° C. Drying (removal of solvent), annealing and densification of the fiber structure take place as in the first embodiment, resulting in a filament which can be hot drawn at a high draw ratio without breakage and which has high strength and modulus after hot drawing.

Overall draw ratios in the second embodiment (typically about 45/1 to about 90/1) tend to be higher than the overall ratios in the first embodiment of the invention (typically about 36/1 to about 54/1). However, the physical properties of the fibers produced tend to be in the same range in both embodiments. In both the first and second embodiments, a higher overall draw ratio tends to result in better product properties.

The second embodiment of the invention is highly desirable from a process standpoint. Shorter drying times make it possible to use faster filament speeds in the drying step compared to those used in the first embodiment. This is possible since wet drawing gives a thinner gel fiber with less solvent in the gel. This is important because drying speed is the limiting factor on output rate in high speed continuous operation.

While the present process has been illustrated as a succession of separate steps in which the take-up drum for each step of the operation becomes the feed drum for the next, it will be understood that the process can be carried out as a continuous operation from beginning to end. Of course, this requires some adjustment of operating speeds since the take-up roll speeds for a given step (say cooling) and the feed roll speeds for the next step (say drying) are not always equal.

By drying the filament in the manner described herein, at a temperature of at least 60° C. when decalin is the solvent at this stage and at a temperature of at least 55° C. when a more volatile solvent such as n-hexane is present, it is possible to obtain fibers having high modulus and tenacity. Surprisingly, physical properties of the product fiber improve as drying temperature is increased. This is very surprising in view of prior art teachings (Smith et al, cited supra, for example) that better physical properties are obtained on solution spun polyethylene gel fibers that are hot drawn immediately after they are generated. Furthermore, the excellent physical properties are obtained according to this invention while operating at considerably higher roll speeds than is possible in presently known processes. Thus, for example, production speeds of 300 cm/min. (the speed of the take-up roll 26 in the hot drawing step) were routinely practiced. Good physical properties (e.g. tensile modulus and tenacity) were obtained. Much higher production speeds, up to 6,000 cm/min. were achieved without breakage of the filament. Even higher filament speeds are possible, provided that an appropriate combination of filament drawing temperature and residence time is used. Physical properties of fibers produced at speeds up to 3,000 cm/min. were substantially as good as those achieved at production speeds of 300 cm/min. The combination of modulus and tenacity values obtained according to the present invention are generally comparable to those obtained in the process of U.S. Pat. No. 4,413,110, but are attainable at higher production speeds up to 30 to 60 times faster. Furthermore, the good physical properties and high operating speeds herein can be obtained without solvent exchange, although a solvent exchange step may be included if desired.

Tensile modulus and tenacity of polyethylene fibers produced according to the present invention are in general much higher than that of a representative aramid fiber ("Kevlar" 29) which was found to have an elastic modulus of approximately 500 grams per denier and a tenacity of about 22 grams per denier.

Fibers produced according to the present invention are in general useful where high strength, high modulus, toughness, dimensional and hydrolitic stability and high resistance to creep under sustained loads are required. For example, marine ropes and cables, such as the mooring lines used to secure supertankers to loading stations, may be made from the fibers of the present invention. These are presently constructed of materials such as nylon, polyester, aramid and steel.

Fibers of the present invention are also useful as reinforcements in thermoplastics, thermosetting resins and elastomers for use in such as pressure vessels, hoses, power transmission belts, and sports, automotive, aircraft and aerospace equipment. In general, fibers produced according to the present invention may be used in applications where rigid wholly aromatic polymeric fibers such as aramid are now used, except for high temperature applications where the higher melting point of aramid gives such fibers an advantage. Furthermore, fibers of the present invention can be produced at much lower cost than can fibers of aramid or other rigid wholly aromatic polymers, due in no small part to the high production speeds obtainable in the present invention.

The high production speeds obtainable in the present invention without sacrifice of fiber physical properties are indeed surprising.

This invention will now be described in further detail with reference to the examples which follow.

The polymer used in all the examples below was linear polyethylene ("Hostalen" Gur-412, obtained from American Hoechst Corp.), having an intrinsic viscosity (IV) of 15 deciliters per gram at 135° C. in decalin, a number average molecular weight ($M_n$) of $10\times10^4$ and a weight average molecular weight ($M_w$) of $1.5\times10^6$.

The solvent used in all the examples to dissolve the polyethylene was decalin (decahydronapthalene).

EXAMPLE 1

This example illustrates the first embodiment of the invention as shown in FIG. 1.

A glass bottle was charged with 2.0 wt. % linear polyethylene, 97.5 wt. % decalin, and 0.5 wt. % di-tert-butyl-p-cresol (DBPC) antioxidant. The charge was heated to 150° C. with rotation at 20–40 rpm under nitrogen pressure over a period of 48 hours. Solution prepared in this manner was used in all examples.

The solution was transferred to a metal cylinder heated to 135° C. and fitted with a metal spinneret having a single cylindrical capillary opening 1 mm in diameter. The temperature of the spinneret was maintained at 128° C. A nitrogen pressure of 15 psi was applied to extrude the charge through the spinneret. The extruded solution filament traversed a small air gap and was then quenched to a gel by passage through a room temperature water bath of water flowing toward the moving gel fiber. The air gap between the die and water was 12 mm and the length of the water bath was 550 mm. The gel filament was then wound on a 32.2 cm diameter drum at the rate of 820 cm/min.

The gel filament was subsequently unwound from the drum at 300 cm/min., transported through a hot air drier device which was operated at 83° C., and taken up on a drum at a take-up speed of 360 cm/min. The fiber path in the drier was approximately 1500 cm in length, giving a drying time of about 4.5 min. Thus, a slight drawing of 1.2/1 was applied.

The dried gel fiber was fed over a hot plate 41 cm long and taken up on a drum at a take-up speed of 300 cm/min, giving a hot draw ratio of 45/1 . The temperature along the hot plate increased from 128° C. to a maximum of 146° C. The time of drawing was 16 seconds. The properties of the stretched fiber were:

| | |
|---|---|
| Denier | 3.1 |
| Tenacity | 32 g/d |
| Tensile Modulus | 870 g/d |

Operating conditions and results of this example and the other examples herein are given in Table I.

EXAMPLES 2–4

The procedure of Example 1 was followed with the exceptions shown in Table I. Results are given in Table I.

In Example 2, one can see that high drying temperatures (100° C.) can be used successfully. Higher temperatures are important to increase the speed of the drying process.

Example 3 demonstrates the use of a conical glass spinneret. This probably results in higher orientation of spun fibers and in higher mechanical properties. Both Examples 2 and 3 show that higher take-up speed of spinning decreases total draw ratio, presumably because of higher orientation of spun fibers. Mechanical properties in Example 3 were better than those in Example 2, although spinning take-up speeds were the same and total draw ratios were nearly the same.

In Example 4, the die of the spinneret was immersed in the water bath. This clearly had no adverse impact on the result.

EXAMPLES 5-13

These examples illustrate operation according to second embodiment of this invention, as shown in FIG. 2.

TABLE I

| | EXAMPLE | | | | | | | | | | | | |
|---|---|---|---|---|---|---|---|---|---|---|---|---|---|
| | 1 | 2 | 3 | 4 | 5 | 6 | 7 | 8 | 9 | 10 | 11 | 12 | 13 |
| Spinning | | | | | | | | | | | | | |
| Temperature of Solution, °C. | 135 | 130 | 135 | 140 | 135 | 135 | 135 | 135 | 135 | 135 | 135 | 135 | 135 |
| Type of Spinneret | Cylin (Metal) | Cylin (Metal) | Conic (Glass) | | | | | Cylindrical (Metal) | | | | | |
| Diameter of Spinneret Opening, mm | 1 | 1 | 1 | 1 | 1 | 1 | 1 | 1 | 1 | 1 | 1 | 1 | 1 |
| Temperature of Spinneret, °C. | 128 | 139 | 128 | 134 | 138 | 138 | 138 | 132 | 132 | 132 | 132 | 132 | 132 |
| Pressure of Extrusion, psi | 15 | 15 | 15 | 15 | 20 | 20 | 20 | 12 | 12 | 12 | 12 | 12 | 12 |
| Air Gap, mm | 12 | 12 | 12 | * | 2 | 2 | 2 | 2 | 2 | 2 | 2 | 2 | 2 |
| Take-up Speed, cm/min | 820 | 2050 | 2050 | 820 | 410 | 410 | 410 | 353 | 353 | 353 | 503 | 503 | 503 |
| Wet Drawing | | | | | | | | | | | | | |
| Temperature, °C. | — | — | — | — | 20 | 20 | 20 | 20 | 20 | 20 | 20 | 20 | 20 |
| Take-up Speed, cm/min | — | — | — | — | 400 | 400 | 400 | 300 | 300 | 300 | 300 | 300 | 300 |
| Draw Ratio | — | — | — | — | 2.4 | 4.5 | 6.8 | 2.2 | 5.9 | 6.3 | 6.5 | 6.5 | 6.5 |
| Drying | | | | | | | | | | | | | |
| Temperature, °C. | 83 | 100 | 83 | 83 | 62 | 62 | 62 | 80 | 80 | 80 | 40 | 60 | 80 |
| Speed, cm/min | 300 | 300 | 300 | 300 | 400 | 400 | 400 | 300 | 300 | 300 | 300 | 300 | 300 |
| Draw Ratio in Dryer | 1.2 | 1.3 | 1.2 | 1.2 | 1.2 | 1.2 | 1.2 | 1.2 | 1.2 | 1.2 | 1.2 | 1.2 | 1.2 |
| Hot Drawing | | | | | | | | | | | | | |
| Hot Plate Length, cm | 41 | 41 | 41 | 41 | 41 | 41 | 41 | 41 | 41 | 41 | 41 | 41 | 41 |
| Temperature, °C. | 146 | 146 | 146 | 146 | 146 | 146 | 146 | 146 | 146 | 146 | 146 | 146 | 146 |
| Take-up Speed, cm/min | 300 | 300 | 300 | 300 | 300 | 300 | 300 | 300 | 300 | 300 | 300 | 300 | 300 |
| Time of Drawing, sec | 16 | 16 | 16 | 16 | 16 | 16 | 16 | 16 | 16 | 16 | 16 | 16 | 16 |
| Draw Ratio | 45 | 28 | 31 | 43 | 27.7 | 12.1 | 6.1 | 32.4 | 10.3 | 5.6 | 8.1 | 8.0 | 9.3 |
| Total Draw Ratio | 54 | 36.4 | 37.2 | 51.6 | 80 | 66 | 50 | 88 | 73 | 43 | 63 | 63 | 72 |
| Properties | | | | | | | | | | | | | |
| Denier | 3.1 | 1.5 | 2.7 | 4.1 | 4.5 | 5.5 | 7.2 | 3.6 | 4.1 | 6.5 | 5.1 | 5.4 | 4.6 |
| Tenacity, g/d | 32 | 31 | 33 | 36 | 31 | 28 | 25 | 34 | 26 | 24 | 25 | 26 | 30 |
| Tensile Modulus, g/d | 870 | 837 | 900 | 919 | 857 | 788 | 760 | 860 | 913 | 695 | 716 | 745 | 881 |

*Immersed in Water

In this embodiment of the invention, the fibers were spun, wet drawn, then dried and hot drawn. Spinning, drying and hot drawing were carried out as in Example 1 except for differences in conditions as shown in Table I. Wet drawing before drying decreases fiber diameter which can result in higher speed of the drying process.

Comparison of Examples 11, 12 and 13 shows that drying temperature has a profound effect on the strength and modulus of the product fiber. Higher drying temperatures provide fibers with better properties. Examples 9 and 13 demonstrate that high modulus fibers can be obtained with a comparatively high wet draw ratio (5.9/1 and 6.5/1, respectively) at a drying temperature of 80° C. Comparison of Examples 9 and 13 with Examples 7 and 10 suggests that higher hot draw ratios lead to better mechanical properties even at high wet draw ratios.

Overall, mechanical properties in Examples 5-13 were not quite as good as those in Examples 1-4. However, good results were obtained in Examples 5, 8, 9 and 13, suggesting that the poorer mechanical properties in Examples 6, 7 and 10-12 were due to less than optimum choice of conditions rather than to any inherent disadvantages in the second embodiment of the process.

While in accordance with the patent statutes, a preferred embodiment and best mode has been presented, the scope of the invention is not limited thereto, but rather is measured by the scope of the attached claims.

What is claimed is:

1. A process for making a polymer filament having high tensile strength and high modulus, comprising the steps of:

(a) spinning a solution of polyethylene or polypropylene having a weight average molecular weight of at least 500,000, and containing from about 0.5 to about 20 weight percent polymer, through an aperture at a temperature above the gelation temperature of the solution and below the boiling point of the solvent, thereby forming a wet spun filament;

(b) cooling said wet spun filament without drying to a temperature below the gelation temperature of the polymer solution thereby forming a gel fiber filament;

(c) wet drawing said gel fiber filament at ambient temperature in air;

(d) continuously passing the gel filament through a drying zone which is maintained at a temperature from about 60° C. to the melting point of the polymer and at a pressure of not less than substantially atmospheric pressure; and (e) continuously passing the dried filament through a hot drawing zone in which said filament is heated and hot drawn;

said process being carried out without solvent exchange whereby the spinning solution solvent remains in the fiber until removed by drying.

2. A process according to claim 1 in which said polymer is polyethylene.

3. A process according to claim 1 in which the solvent content of said filament after drying is not over about 8 percent by weight.

4. A process according to claim 1 in which said drying is carried out in a current of forced air or by means of heated rolls.

5. A process according to claim 1 in which the wet draw ratio is at least 2.

6. A process according to claim 1 in which the hot drawing temperature of the fiber does not exceed the polymer melting point.

7. A process according to claim 1 in which the hot draw ratio is at least about 5/1.

* * * * *